US005484056A

United States Patent [19]

Wood

[11] Patent Number: 5,484,056

[45] Date of Patent: Jan. 16, 1996

[54] DISPLAY HANGER HAVING AN ELASTOMERIC ARTICLE RETAINER

[75] Inventor: Peter C. Wood, Georgetown, S.C.

[73] Assignee: Cooper Industries, Inc., Houston, Tex.

[21] Appl. No.: 358,591

[22] Filed: Dec. 14, 1994

[51] Int. Cl.[6] ..... B65D 73/00; B65D 85/20

[52] U.S. Cl. ..... 206/349; 206/461; 206/477; 206/486

[58] Field of Search ..... 206/349, 460, 206/461, 462, 476, 477, 478, 479, 480, 481, 482, 486

[56] References Cited

U.S. PATENT DOCUMENTS

| | | | |
|---|---|---|---|
| 1,553,827 | 9/1925 | Lee . | |
| 3,604,565 | 9/1971 | Freeman . | |
| 3,770,120 | 11/1973 | Hanson . | |
| 3,870,144 | 3/1975 | Hanson . | |
| 4,019,632 | 4/1977 | Greenlee . | |
| 4,450,961 | 5/1984 | Bies et al. . | |
| 4,586,615 | 5/1986 | Quitmann . | |
| 4,631,783 | 12/1986 | Hayashi . | |
| 4,634,005 | 1/1987 | Kulzer et al. | 206/349 X |
| 4,667,826 | 5/1987 | Salacuse | 206/461 |
| 4,729,473 | 3/1988 | Kulzer et al. | 206/486 X |
| 4,899,877 | 2/1990 | Kiernan . | |
| 5,279,420 | 1/1994 | Rodgers | 206/461 X |

*Primary Examiner*—Jacob K. Ackun
*Attorney, Agent, or Firm*—Burns, Doane, Swecker & Mathis

[57] ABSTRACT

A display hanger for an article such as a screwdriver includes a body having an aperture for receiving a hanger hook, and a downwardly depending tongue. The tongue includes a pair of arch-shaped pockets which are open at a rear face of the body. An elastomeric grommet is installable into the body. The grommet is formed of one piece and includes two arch-shaped sections and an integral web interconnecting the sections to define a hinge. The grommet sections include respective holes which can be brought into alignment by folding the grommet about the hinge. The sections of the folded grommet can be inserted simultaneously into the pockets and held therein by friction and/or rib-and-groove couplings. The screwdriver is inserted vertically through both holes of the grommet and retained therein by friction fit.

11 Claims, 3 Drawing Sheets

FIG. 1
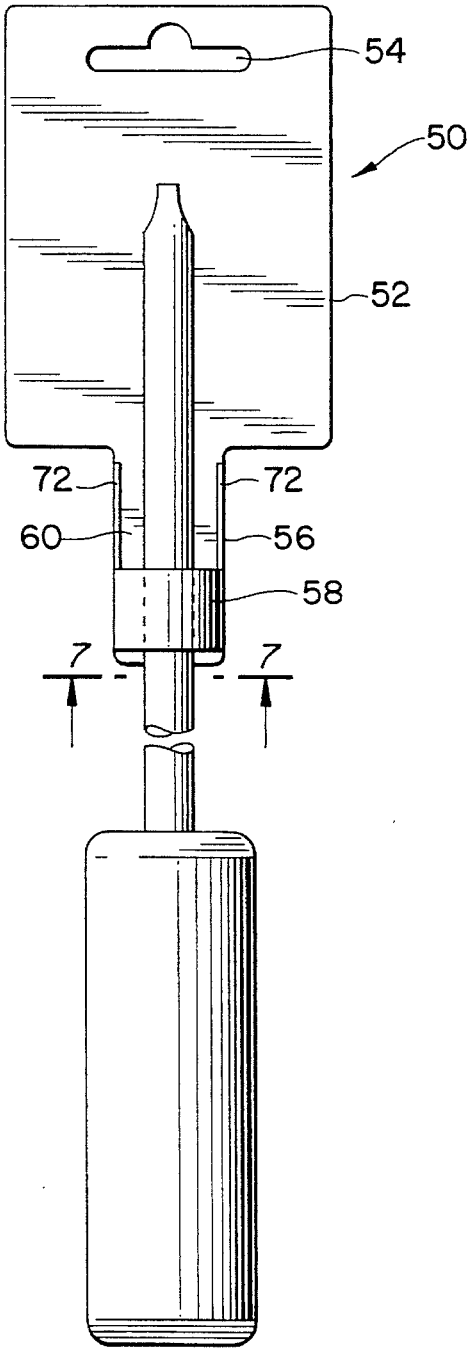
FIG. 2
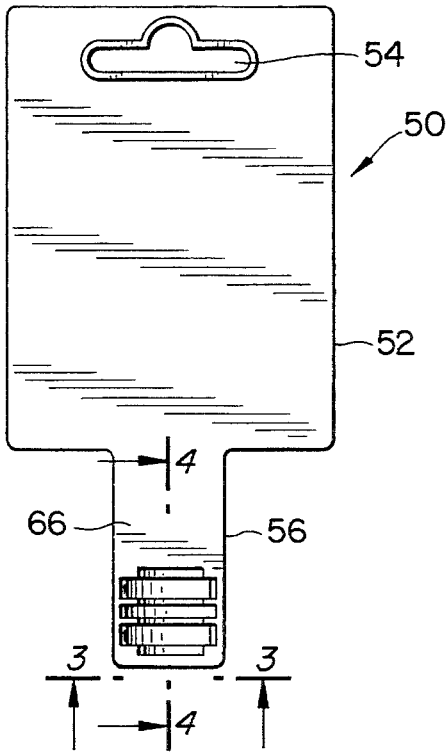
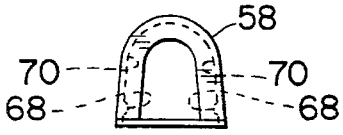
FIG. 3
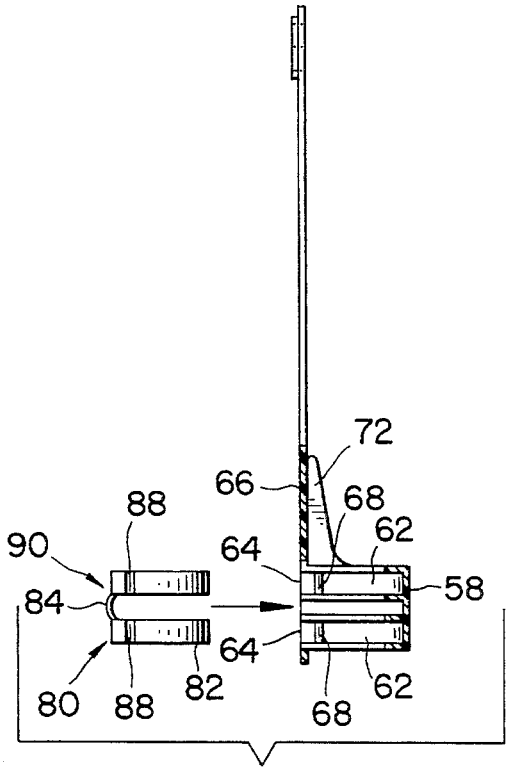
FIG. 4

FIG. 5
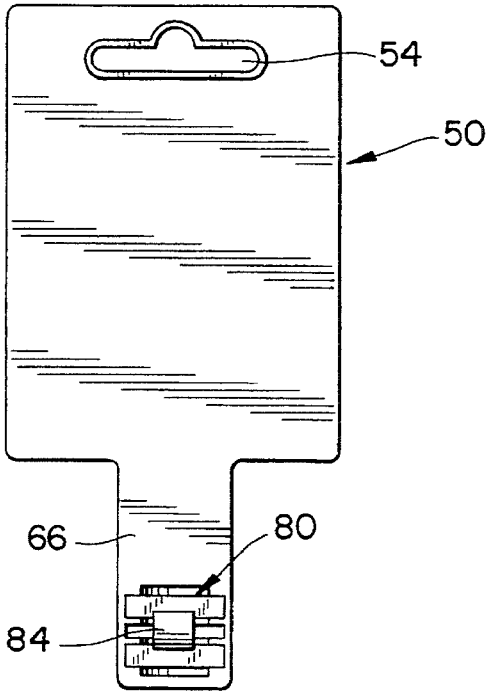
FIG. 6
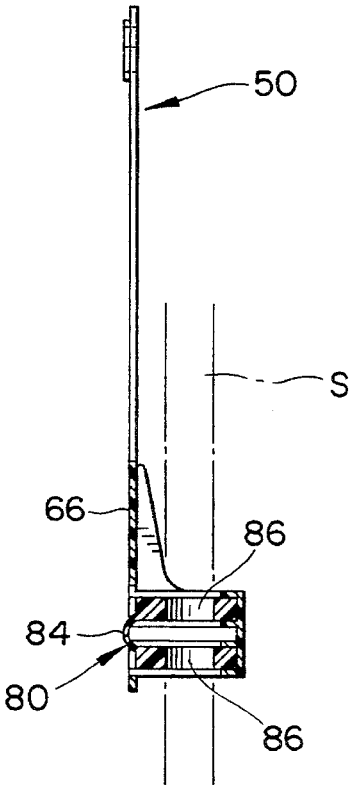
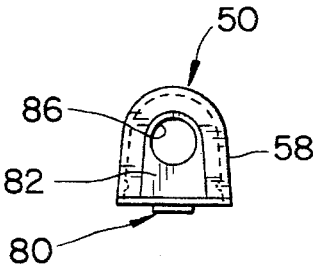
FIG. 7
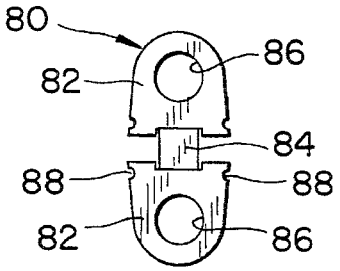
FIG. 8
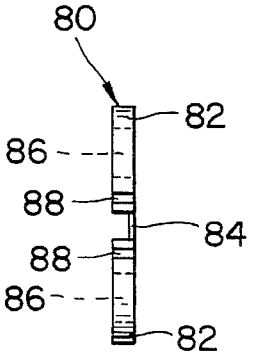
FIG. 9

FIG. 10
(PRIOR ART)
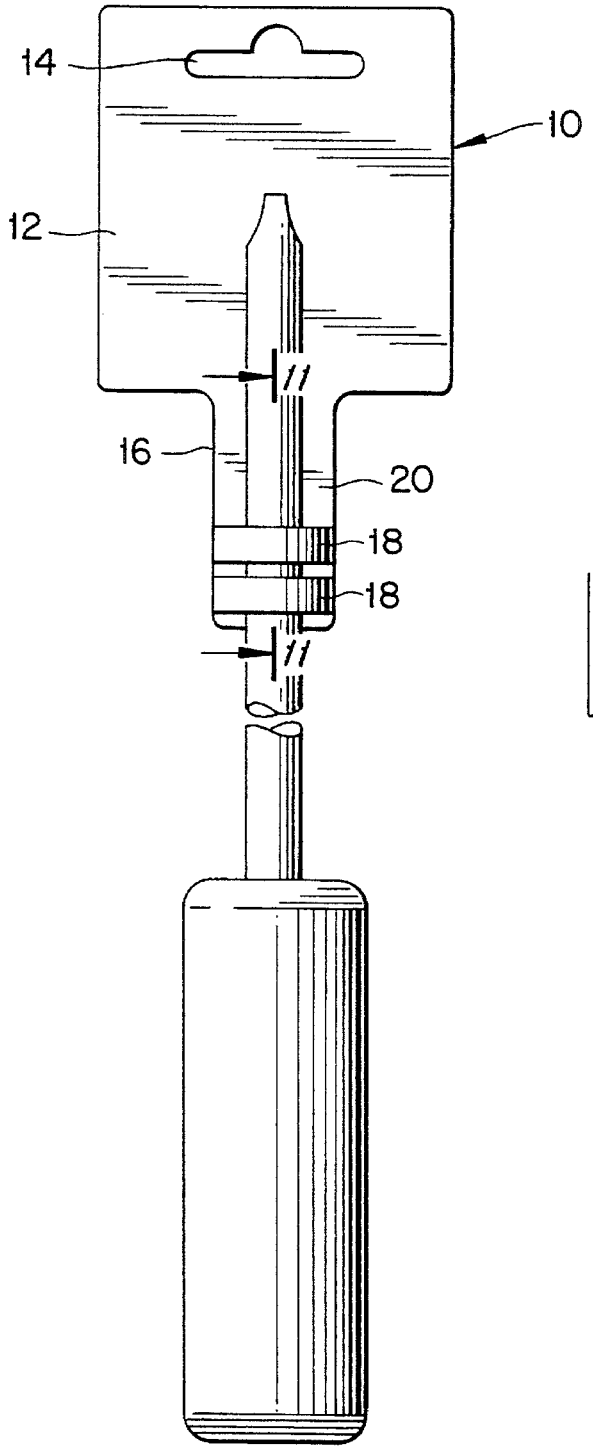
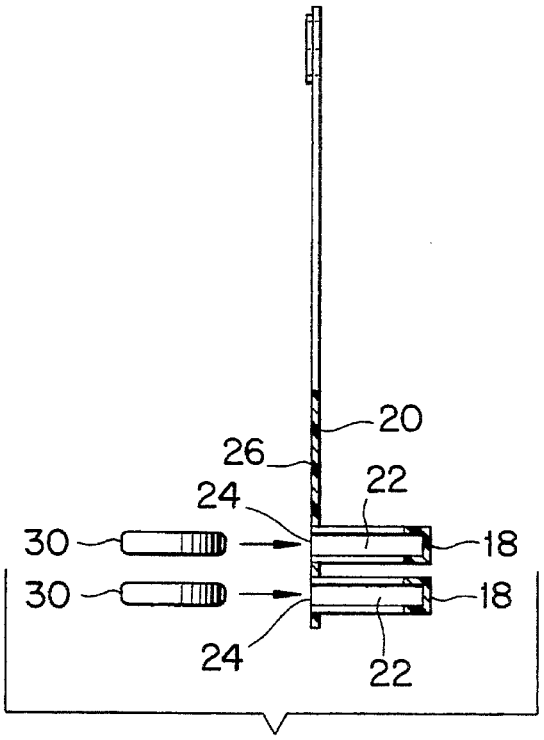
FIG. 11
(PRIOR ART)
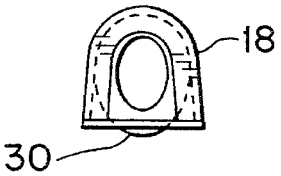
FIG. 12
(PRIOR ART)

DISPLAY HANGER HAVING AN ELASTOMERIC ARTICLE RETAINER

BACKGROUND OF THE INVENTION

The invention relates to display hangers for suspending products, such as hand tools, for convenient display, e.g., in a store or workplace.

A conventional display hanger 10 for handing a screwdriver S on a display rack is depicted in FIGS. 10–12. The hanger 10 comprises a plastic paddle-shaped body 12 having an aperture 14 for receiving a hook (not shown). The body 12 includes a downwardly projecting tongue 16 having a pair of arch-shaped elements 18 projecting outwardly from a front face 20 of the tongue 16. Each arch-shaped element 18 forms an internal arch-shaped pocket 22 which is open upwardly, downwardly, and rearwardly. The pockets are open rearwardly by means of openings 24 formed in a rear face 26 of the tongue. Each pocket is sized to receive a circular rubber O-ring 30. The width W of each pocket is smaller than an outer diameter of the O-ring 30, causing the O-ring to be compressed and held by friction fit when installed in its pocket.

The O-rings 30 are manually installed, whereupon their center holes 32 are longitudinally aligned so that an article having a shaft, such as a hand tool (e.g., a screwdriver S, socket driver, etc.) can be installed by longitudinally pushing the shaft through the aligned holes. The article is thus held by friction fit in the O-rings to enable the hanger to be suspended from a hook on a display rack.

The act of assembling the O-rings into the pockets is awkward because the O-rings are small and hard to grasp. Also, due to their thinness, the O-rings may tend to twist when placed under compression during installation, thereby further hindering movement into the pocket.

Since the hangers are intended for single (i.e., non-repeat) use by the manufacturer (although the purchaser might continue to use them to hang articles such as tools in a workshop), they are made in large numbers. Hence, it would be particularly advantageous to make the assembly process for the hangers easier and quicker, as well as to reduce the overall cost of the elastic holder.

SUMMARY OF THE INVENTION

The present invention involves a display hanger for suspending an article. The display hanger comprises a body having a front face, a rear face, and a suspension structure (preferably an aperture) enabling the body to be suspended from a support. Pockets are formed on the body below the suspension structure. Each pocket projects forwardly from the front face and defines a passage extending parallel to the front face. The passages are aligned with one another for enabling an article to extend therethrough. Each pocket includes an access opening through the rear face. A one-piece grommet is provided which is formed of an elastomeric material. The grommet includes a pair of sections interconnected by an integral web. Each section has a through-hole and is configured to be mounted in a respective one of the pockets so that the through-hole is aligned with the respective passage. The web which interconnects the sections defines a hinge that enables the grommet to be folded over to orient the through-holes is mutually aligned relationship and to be simultaneously installable into respective pockets through the access openings. The through-holes are adapted to frictionally grip an article extending therethrough.

Preferably, the passages are oriented vertically when the display hanger is in a suspended state.

Each of the pockets is preferably of arch-shaped configuration, and each of the grommet sections is preferably also arch-shaped.

Each pocket and its respective grommet section are preferably interlocked by a projection-and-recess coupling. That coupling preferably comprises ribs formed in each pocket, and grooves formed on each grommet section for receiving the ribs.

BRIEF DESCRIPTION OF THE DRAWINGS

The objects and advantages of the invention will become apparent from the following detailed description of a preferred embodiment thereof, in connection with the accompanying drawings in which like numerals designate like elements and in which:

FIG. 1 is a front view of a display hanger according to the present invention, with a screwdriver mounted therein;

FIG. 2 is a rear view of the display hanger depicted in FIG. 1, without the screwdriver mounted therein, and without a grommet mounted in the hanger;

FIG. 3 is an end view of the display hanger, taken in the direction of the line 3—3 shown in FIG. 2;

FIG. 4 is an exploded view of the display hanger and a grommet in the process of being inserted therein, the display hanger being shown in side view and partially in section taken along the line 4—4 in FIG. 2;

FIG. 5 is a view similar to FIG. 2 with the grommet installed in the display hanger;

FIG. 6 is a view similar to FIG. 4 with the grommet installed, the grommet being depicted in sectional view;

FIG. 7 is a view similar to FIG. 3 with the grommet installed;

FIG. 8 is a plan view of the grommet in an unfolded condition;

FIG. 9 is a side view of the grommet depicted in FIG. 8;

FIG. 10 is a front view of a prior art display hanger;

FIG. 11 is an exploded view of the prior art display hanger of FIG. 10 as O-rings are being installed therein, the display hanger being partially sectioned along line 11—11 of FIG. 10; and FIG. 12 is an end view of the prior art display hanger depicted in FIG. 10 after the O-rings have been installed therein.

DETAILED DESCRIPTION OF A PREFERRED EMBODIMENT OF THE INVENTION

A display hanger 50 depicted in FIGS. 1–9 includes a plastic paddle-shaped body 52 having an aperture 54 for receiving a hook (not shown). The body 52 includes a downwardly extending tongue 56 having an arch-shaped element 58 (the arch shape being visible in FIG. 3) projecting outwardly from a front face 60 of the tongue 56. The arch-shaped element 58 forms a pair of internal arch-shaped pockets 62 (see FIG. 4), each of which is open upwardly (i.e., toward the aperture 54), downwardly (away from the aperture 54), and rearwardly (to the left in FIG. 4).

The pockets 62 are open rearwardly by virtue of access openings 64 formed in a rear face 66 of the tongue 56. Each pocket forms a passage which extends vertically when the hanger is suspended. The passages are aligned with one another and are parallel to the front face 60.

Each pocket includes locking projections in the form of ribs 68 (see FIG. 3) projecting inwardly into the pocket from opposite sides 70 thereof at a location near the opening 64.

Reinforcing flanges 72 (see FIG. 4) extend longitudinally along respective edges of the front face 66 of the tongue 56 to stiffen the tongue against twisting and bending.

The body can be formed of any suitable material, such as a plastic, a polyolefin such as high density polyethylene has been particularly suitable and conveniently recyclable.

An elastic grommet 80 depicted in FIGS. 8 and 9 is installable into the arch-shaped element 58 for gripping an article (such as a screwdriver S). The grommet 80 is of one-piece molded construction and includes a pair of identical arch-shaped sections 82 interconnected by an integral web 84 that forms a hinge. Each of the sections 82 includes a circular through-hole 86 and a pair of locking recesses in the form of grooves 88 facing outwardly.

The grommet is formed of an elastomeric material such as rubber or plastic. One material which is of suitable elasticity and is readily recyclable is ethyl vinyl acetate (EVA). The grommet can be folded about its integral hinge upon being pinched between an installer's fingers. Such a folded condition is depicted in FIG. 4, wherein the axes of the through-holes 86 are mutually aligned. The two arch-shaped sections 82 of the grommet 80 can thus be inserted simultaneously through the access openings 64 and into respective pockets 62. Once those sections 82 have been partially inserted into the pockets, they can be pushed the remainder of the way by the installer who pushes against the rear hinged region 90. The sides of the sections 82 flex as they travel across the locking ribs. When the locking grooves 88 of the grommet become aligned with the locking ribs 68, the ribs 68 and grooves 88 will snap together and thereby resist dislodgement of the grommet by interference fit. This enable the hanger 50 to be handled relatively roughly, i.e., jostled and otherwise impacted before an article is inserted therein, without serious risk of the grommet being dislodged, as might occur if only a friction fit were relied upon.

Once the grommet 80 has been freely installed, the through-holes 86 thereof will be aligned with the vertical passages formed by the pockets and will be able to frictionally retain an article S inserted therethrough. The article, such as the screwdriver S, can be inserted by being pushed longitudinally through the aligned holes 86. The diameter of each hole 86 is made slightly smaller than the shaft diameter of the article to create a desired friction fit between the shaft and the grommet sections 82.

It will be appreciated that the grommet according to the present invention involves a single element that provides two holes for retaining an article. The grommet is less costly to produce than a pair of O-rings and is larger than an O-ring so as to be easier to handle. The single-piece grommet can be installed more quickly than two O-rings. The end of the grommet is larger than the end of an O-ring, thereby enabling an installer to push it into the paddle body easily with less risk of buckling.

In lieu of rib-shaped locking projections and groove-shaped locking recesses, the projections could comprise generally spherical or cylindrical bumps, and the recess could comprise correspondingly shaped dimples. Other shapes are also possible. Alternatively, the groove or dimple could be formed in the arch-shaped element 58, and the rib or bump could be formed in the grommet.

The provision of locking projections and locking recesses is optional. Instead, the grommet could be held in the pockets solely by a friction fit.

The through-holes formed in the grommet could have any desired shape other than circular, such as rectangular, oval, etc.

Although the present invention has been described in connection with a preferred embodiment thereof, it will be appreciate by those skilled in the art that additions, deletions, modifications, and substitutions not specifically described may be made without departing from the spirit and scope of the invention as defined in the appended claims.

What is claimed is:

1. A display hanger for suspending an article, comprising:

a body having a front face, a rear face, and a suspension structure enabling the body to be suspended from a support;

pockets formed on said body below said suspension structure, each pocket projecting forwardly from said front face and defining a passage extending parallel to said front face, said passages being aligned with one another for enabling an article to extend therethrough, each pocket including an access opening through said rear face; and a one-piece grommet formed of an elastomeric material, said grommet including:

a pair of sections each having a through-hole and configured to be mounted in a respective one of said pockets so that said through-hole is aligned with said passage thereof, and a web integral with and interconnecting said sections to define a hinge enabling said grommet to be folded over to orient said through-holes in mutually aligned relationship and be simultaneously installable into respective pockets through said access openings, said through-holes being adapted to frictionally grip an article extending therethrough.

2. The display hanger according to claim 1, wherein said passages are oriented vertically when the display hanger is in a suspended state.

3. The display hanger according to claim 1, wherein said suspension structure comprises an aperture for receiving a hook.

4. The display hanger according to claim 1, wherein each of said pockets is generally arch-shaped, and each of said sections of said grommet being generally arch-shaped.

5. The display hanger according to claim 1, wherein each pocket and its respective grommet section are interlocked by a projection-and-recess coupling.

6. The display hanger according to claim 5, wherein said projection-and-recess coupling comprises ribs formed in each pocket, and grooves formed on each grommet section for receiving said ribs.

7. The display hanger according to claim 1, wherein said body includes a downwardly projecting tongue on which said pockets are disposed, said tongue including reinforcing flanges disposed along opposite edges thereof.

8. The display hanger according to claim 1, wherein said grommet is formed of ethyl vinyl acetate.

9. The display hanger according to claim 1, wherein there are only two said pockets.

10. A display hanger for suspending an article, comprising:

a body having a front face, a rear face, a downwardly depending tongue, and an aperture extending through said body at a location higher than said tongue for receiving a support hook;

a pair of arch-shaped pockets formed on said body, each pocket projecting forwardly from said front face and defining a vertical passage extending parallel to said front face, said passages being aligned with one another for enabling an article to extend vertically therethrough, each pocket including an access opening through said rear face; and a one-piece grommet formed of an elastomeric material, said grommet including:

a pair of arch-shaped sections each having a through-hole and configured to be mounted in a respective one of said pockets so that said through-hole is aligned with said passage, and a web integral with and interconnecting said sections to define a hinge enabling said grommet to be folded over to orient said through-holes in vertically aligned relationship and be simultaneously installable into respective pockets through said access openings, said through-holes being adapted to frictionally grip an article extending therethrough;

each pocket and its respective grommet section being interlocked by a projection-and-recess connection.

11. The display hanger according to claim 10, wherein said projection-and-recess connection comprises projections formed in each pocket and grooves formed on each grommet section for receiving said projections.

* * * * *